United States Patent [19]

Olofsson et al.

[11] Patent Number: 4,572,152

[45] Date of Patent: Feb. 25, 1986

[54] AIR GUNS WITH FLOATING PISTON RECEIVED IN COMPENSATING CHAMBER WHICH IS FORMED IN MAIN PISTON

[76] Inventors: Sigfrid M. Olofsson, Syrenvägen, 7, S-45500 Munkedal, Sweden; Chester H. Wickenberg, 85, S. Crystal, Elgin, Ill. 60120

[21] Appl. No.: 433,098

[22] Filed: Oct. 6, 1982

[30] Foreign Application Priority Data

Oct. 7, 1981 [ES] Spain ..... 506.667
May 19, 1982 [ES] Spain ..... 513.092

[51] Int. Cl.[4] ..... F41B 11/00
[52] U.S. Cl. ..... 124/69; 124/73
[58] Field of Search ..... 124/66, 67, 68, 69, 124/75, 37, 38, 80, 73; 417/487; 91/173, 416, 422; 92/51, 60; 138/31

[56] References Cited

U.S. PATENT DOCUMENTS 1,612,007 12/1926 Furlong ..... 91/173 X
2,023,771 12/1935 Ringius ..... 417/487 X
2,754,847 7/1956 Ashton et al. ..... 138/31
3,415,442 12/1968 Stoddard et al. ..... 92/60 X
3,955,371 5/1976 Bueler ..... 92/60 X
4,038,961 8/1977 Olofsson ..... 124/68 X

FOREIGN PATENT DOCUMENTS 1553929 1/1971 Fed. Rep. of Germany ..... 124/67
2414115 10/1975 Fed. Rep. of Germany ..... 124/67
1392737 12/1965 France ..... 124/67
895873 5/1962 United Kingdom ..... 92/60

*Primary Examiner*—Richard T. Stouffer
*Attorney, Agent, or Firm*—Cushman, Darby & Cushman

[57] ABSTRACT

An air-gun in which the main cylinder and piston assembly providing the compression of the air for the projection of the shot is associated with another compensating assembly of cylinder and piston, this compensating assembly of piston and cylinder being located in the body of the main piston itself or in a chamber communicating with the main cylinder and comprising a piston free to move within the corresponding cylinder which latter is in communication at one end with the main cylinder and is closed at the other end.

4 Claims, 7 Drawing Figures

AIR GUNS WITH FLOATING PISTON RECEIVED IN COMPENSATING CHAMBER WHICH IS FORMED IN MAIN PISTON

This present invention patent refers to improvements relating to air-guns with particular reference to the air compression piston assembly within the chamber in which the air is held prior to the firing operation.

As is known air-guns have a number of sporting and leisure uses and they are fundamentally based on the impelling of a pellet through the length of the barrel under the impulse of a quantity of previously compressed air, which at the moment of firing is released into the space in which is located the pellet, at the breech of the barrel, such that the potential energy of the compressed air may act on the said pellet, driving it along the barrel, the compressed air's potential energy being converted to kinetic energy of the pellet at the muzzle of the gun, the range and the power of the shot being a function of the magnitude of the said kinetic energy.

With a view to providing an improved accuracy and an increased power of the shot it has been discovered that it is advantageous to provide that the effect of the compressed air on the pellet has a progression greater than that normally obtaining in the simple release mechanisms for the previously compressed air, in which there is on one hand a notable shock in the operation detracting from the accuracy of the aim and on the other a reduction in the potential energy which is effectively transferred to the pellet.

Therefore the improvements, object of this present patent are designed to procure in a basic manner a more progressive action of the compressed air on the shot in the course of its passage through the barrel, such that the force exerted on the pellet is more uniform and the acceleration more constant, thus resulting in a net improvement in the efficiency of the compressed air potential energy and in consequence a definite enhancement of the force of the firing and the accuracy of the aim.

In essence the improvements object of this present patent are based on a combination of the action of the main air discharge piston of the gun with a pneumatic compensating system which operates in unison with the main piston, in such a way that discharge is the result of the operation of the main piston and of the pneumatic compensator.

In accordance with a first embodiment of this present patent the said objects are achieved, fundamentally, by adopting a system of main compression piston which is provided internally with a chamber, closed by a floating piston which is fitted with a special retaining device which allows the passage of air so as to reach a pressure balance between the main compressed air chamber and the said auxiliary chamber, such that once the gun is loaded, that is to say, once the air which is to cause the discharge is compressed, the balance between the pressures in the main chamber and in the said auxiliary chamber is established, separated by the floating piston, such that at the moment of firing the release of energy by the compressed air will have a more progressive character, achieving thus the objectives indicated above.

In this first embodiment there is provided essentially the arrangement of a floating piston in the form of an assembly made up of a stem having at one extremity a circular head acting as the piston itself carrying a retention device attached thereto and at the other extremity having a washer or other means of limiting the axial position of forward displacement of the piston assembly. However the embodiment of a floating piston may vary within wide limits while in all cases meeting the requirement of remaining with the ability to slide within the interior of a chamber or housing in the main piston and having its system of guide and stops which will limit its axial position.

In another prefered embodiment the main air compression piston with which the air-gun is fitted is complemented by an auxiliary piston freely disposed within a chamber arranged in opposition to the main air compression cylinder, this special piston being fitted with a sealing means sliding within the interior of the housing in which it is fitted, such that during the air compression stroke the main piston of the air-gun will cause the compression of the air which will pass partially towards the rear of the auxiliary piston during the initial stage of loading, admitting a specific quantity of air under pressure, where it will be held permanently, so that during discharge cycle it will push the auxiliary piston and thus complete the action of expansion of the main air and result in a more efficient discharge of the air-gun.

According to another embodiment, the sealing means of the compensating piston which separate the main and the auxiliary chambers are air tight, that is, the sealing means will not allow the circulation of air between said main and auxiliary chambers. The auxiliary chamber will be provided with pressurized air at a given pressure.

This could be accomplished for instance by the use of a double-lip sealing means or two opposed air tight seals between the above mentioned main and auxiliary chambers.

To assist the explanation explanatory drawings are attached, by way of example, of the improvements object of this present patent.

Figure 1:
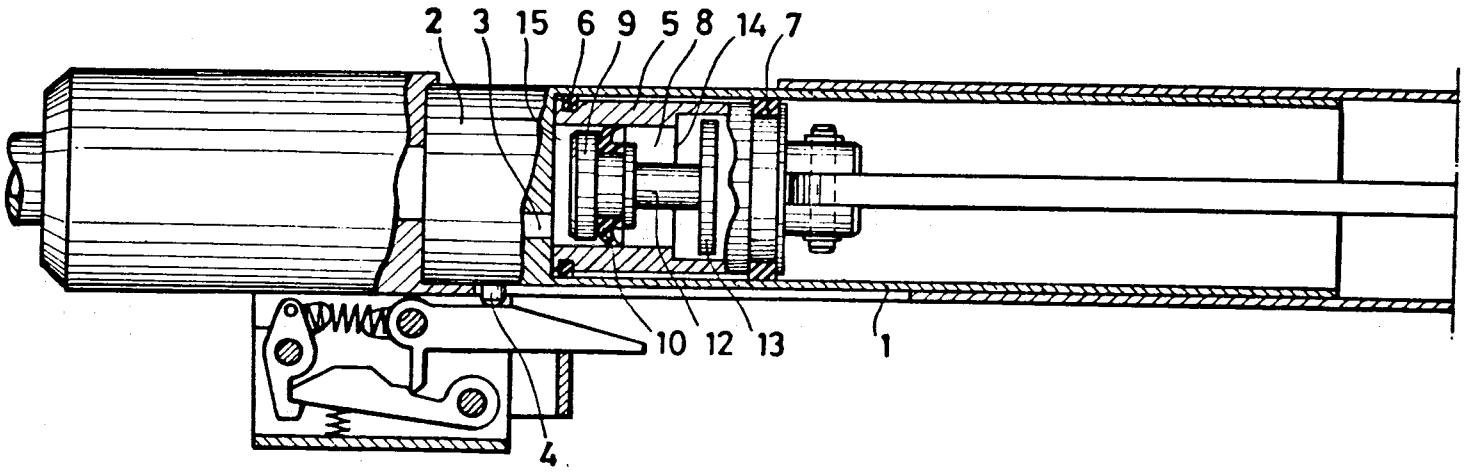
FIGS. 1, 2 and 3 show respectively, longitudinal sections of a piston and cylinder assembly in accordance with these improvements, in their positions of: piston as loaded ready for firing, at rest after firing and prior to the compression of the air in the cylinder.

As may be seen in the drawings the assembly of components relevant to these improvements consists essentially in a cylinder -1- delimited at its front -2- by a tube -3- closed by a valve -4- and to its rear by a piston -5- provided with sealing rings -6- and sliding rings -7-.

The said piston -5- is characterized by the basic feature of being provided with an internal chamber -8- closed by a floating piston -9-, which latter has a special retention means -10- which same, permits the easy passage of air into the interior of the chamber while impeding its outward passage.

The floating piston -5- carries a stem -12- fitted with a washer -13- or other similar means designed to provide an axial stop at the position of an intermediate step -14- in the circular orifice of the piston -5-.

This arrangement of means results in that on operating the air-gun lever, piston -5- is caused to advance thus causing the compression of the air in the chamber -11-, this compression causes the auxiliary chamber -8- of the piston -5- to be filled, the pressure overcoming the joint or retention seal -10-.

The auxiliary chamber -8-, during the initial stages of loading fills with air until there has been established a pressure balance between the air in the main compression chamber -11- and the auxiliary -8-. The air in the latter chamber remains stored permanently therein.

In this manner, with the piston -5- at the end of its compression stroke within the cylinder -1-, in FIG. 1, there is formed an air chamber -15- at the same pressure as the air in in the auxiliary chamber -8-.

Figure 2:
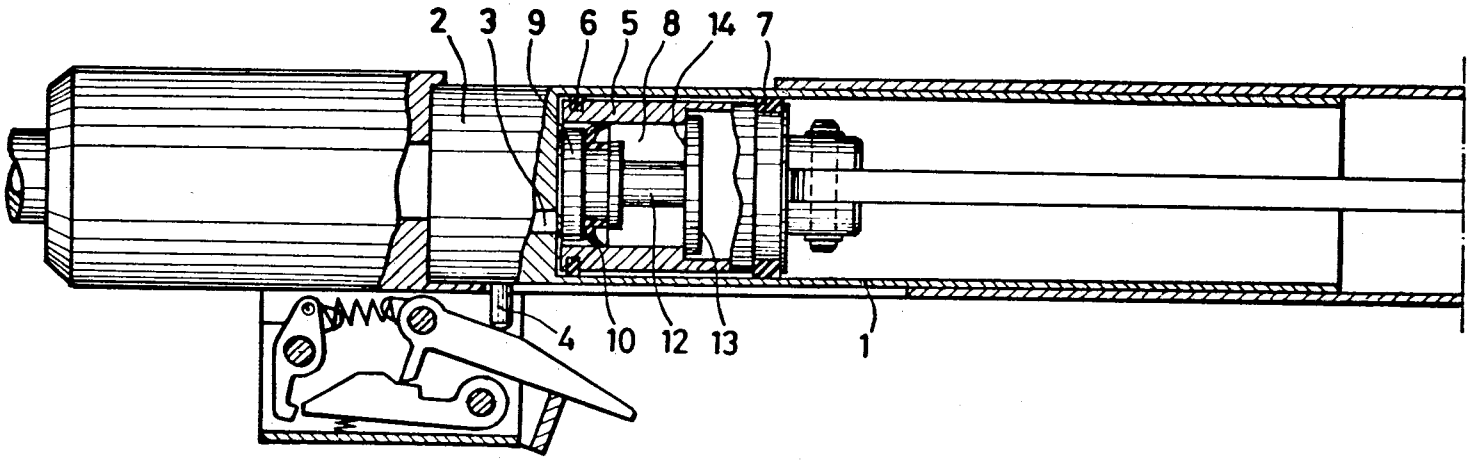
Figure 3:
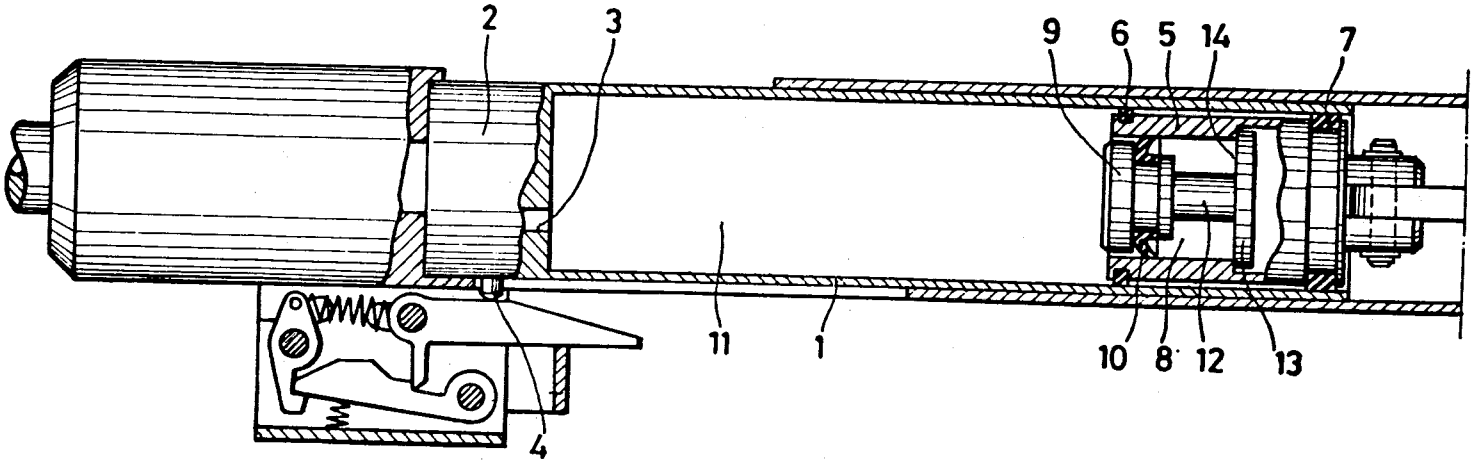

At the moment of firing, as shown in FIG. 2, the valve -4- is opened allowing the expulsion of the compressed air, such that the volume increase due to the expansion is compensated by the floating piston -9- and hence the pressure of the compressed air being released remains constant.

Figure 4:
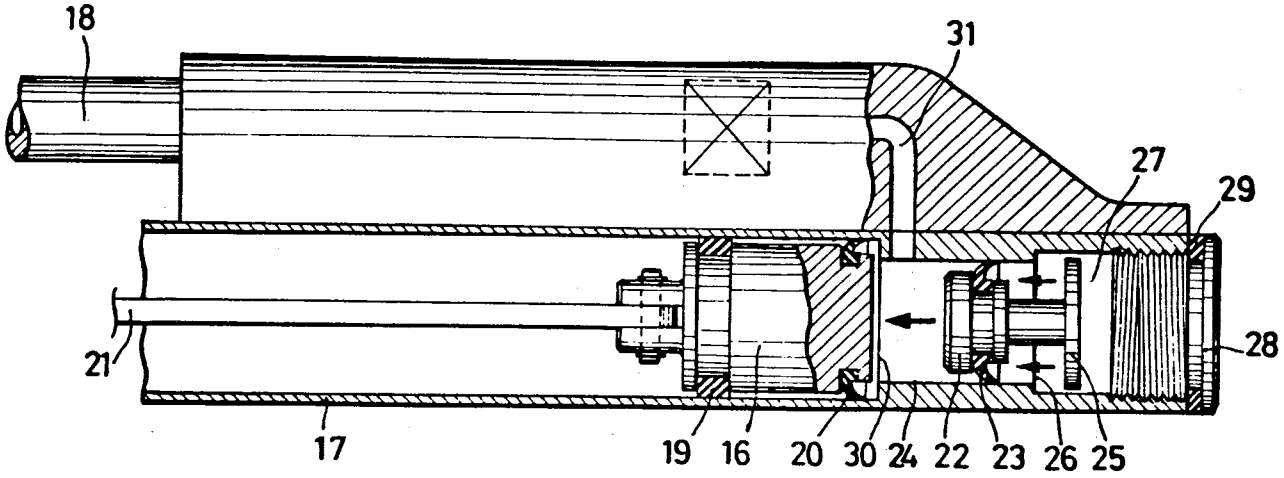
FIG. 4 shows a longitudinal section in which can be seen the arrangement of the main piston, the floating piston and the discharge passage of the air-gun.
Figure 5:
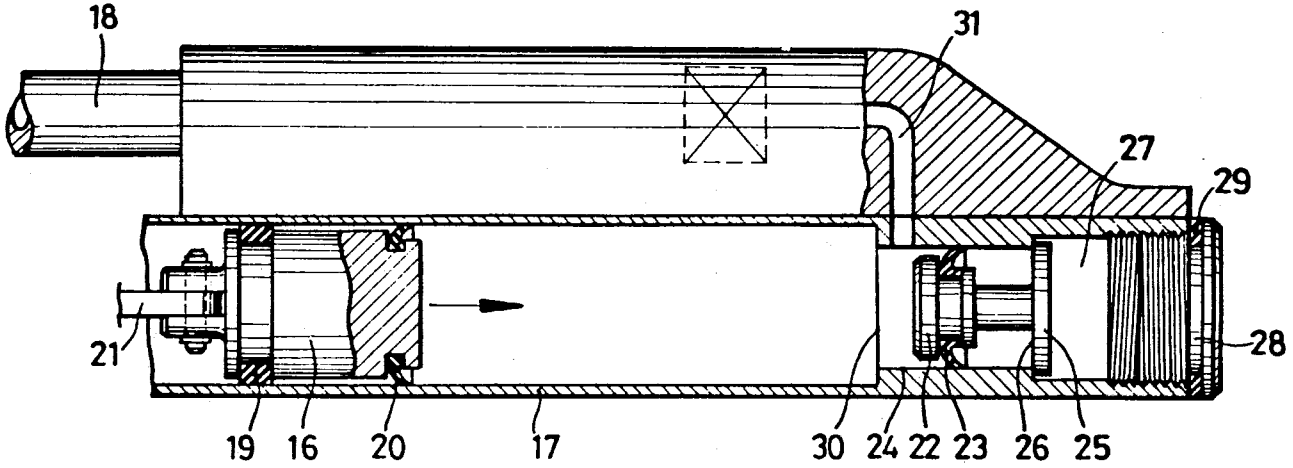
FIG. 5 is a sectional view similar to that of FIG. 4 in which the main piston of the gun is in its loading position prior to compression of the air.

In the embodiments illustrated in FIGS. 4 and 5, the improvements, object of this present patent are provided by the arrangement of a main piston -16- within the interior of an air compression cylinder -17-, this said piston being provided with a set of external seals -19- and -20- preferably the front being a sealing joint and the rear being for friction, thus providing a satisfactory airtightness in the displacement of the piston within the cylinder -17-. This piston is connected to a conventional operating linkage -21-.

These improvements envisage an arrangement of a floating piston -22- in opposition to the main piston -16- and fitted with a specially designed flexible joint -23- which forms a lip directed towards the rear, in opposition to the main piston, sliding within the cavity -24- in which is housed the said free piston -22-. The said piston has at its rear a large guide washer and stop -25-, designed to form a limit stop against an intermediate step -26- and which limits its axial displacement. The cavity -27- which houses the washer -25- is closed at the rear by means, for example, of a cover -28- which applies pressure to a flexible sealing joint -29-.

The main piston -16- equally has an axial limiting position against a step -30- in the main cylinder.

In an intermediate zone between the two stop positions of the respective pistons of the system there is connection to a tube -31- for the discharge of the compressed air which leads to the breech chamber in which is the pellet ready for firing through the barrel -18- of the air-gun.

This arrangement permits the operation to be as follows: on sliding the piston on its loading stroke, from its end position, (FIG. 5), to its limit position, as is shown in FIG. 4, the air present in the interior of the cylinder -17- is compressed, thus ready for the projection of the pellet. On being released the air passes in the direction of the barrel through the tube -31-, under the impulse of the action of the main cylinder and also the expansion of the air in the chamber -27- acting on the piston -22-, this constituting an additional action of air compression during the discharge stage, resulting in this being more effective and regular.

Figure 7:
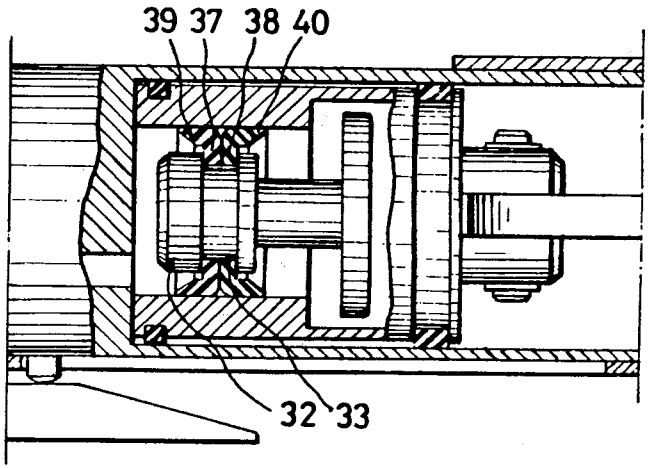
FIGS. 6 and 7 are sectional views of the floating piston with two opposed air tight seals and with a double-lip sealing means respectively.
Figure 6:
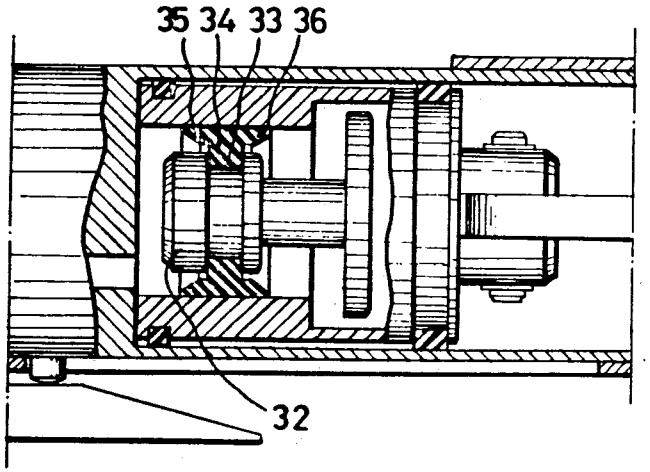

The embodiment shown in FIGS. 6 and 7 provides a floating piston -32- with a sealing means in its intermedial groove -33-. Such sealing means comprises a single sealing ring -34-, with opposed sealing lips -35- and -36-, or alternatively a double seal formed by two single sealing rings -37- and -38-, fitted in such a way that the corresponding peripherical sealing lips -39- and -40- lie in opposed directions. With this embodiment the compensating chamber will be submitted to a previously determined pressure during the assembly of the weapon.

It is understood that variations to the embodiments, shown by way of example, can be introduced, without these being extraneous to the scope of this invention patent. In particular the main piston -16- may be concave and the limit positions of the movement of both pistons can be ensured by means other than those shown with the addition of complementary springs to both pistons if desired.

In this embodiment the floating piston may be arranged otherwise than in opposition to the main piston. Also the exact form of the retention and sealing means may be varied without being extraneous to the scope of the present invention. Equally the invention may be applied to any type of arms operating on compressed air, such as pistols and guns.

This present invention having been disclosed and being considered as novelty, protection is claimed as to the contents of the following clauses:

1. An improved air gun, comprising:
   - a main air compression chamber constructed and arranged with a main air compression piston slidingly received therein to provide compressed air;
   - a mechanical means connected with said main air compression piston, for permitting an air gun user to mechanically force the main air compression piston slidably along in said main air compression chamber so as to compress air therein;
   - a gun barrel;
   - a passageway arranged for communicating said gun barrel with said main air compression chamber for propelling a pellet along said gun barrel;
   - a valve means constructed and arranged in said passageway for selectively closing-off communication of said main air compression chamber by operation of said mechanical means, for release into said gun barrel through said passageway when firing of a pellet is wanted;
   - a compensating chamber having a floating piston slidingly received therein;
   - an air seal formed between said floating piston and said compensating chamber, forming an air chamber which is normally separated by said air seal and said floating piston from said main air compression chamber;
   - means arranging said air chamber of said compensating chamber in respect to said main air compression chamber for enabling said air chamber to receive and transmit variations in pressure with respect to said main air compression chamber by sliding movement of said floating piston, including said compensating chamber being formed in said main air compression piston, whereby air is rapidly transferred between said main air compression chamber and said compensating chamber in a compression phase of firing a pellet from said air-gun upon opening of said valve means, resulting in more progressive and regular action of compressed air on the pellet being fired.

2. The air-gun of claim 1, wherein:
   - said air seal is constructed and arranged to permit a quantum of compressed air to leak unidirectionally from said main air compression chamber past said floating piston into said air chamber of said compensating chamber in an initial use of said air-gun, for providing said air chamber of said compensating chamber with a predetermined pressurization.

3. The air-gun of claim 1, further comprising:

stop means provided for said compensating chamber, this stop means being constructed and arranged to limit axial travel of said floating piston towards said main air compression chamber.

4. The air gun of claim 1, wherein:

said air seal is a double-lip seal.

* * * * *